US008784576B2

(12) United States Patent
Somers et al.

(10) Patent No.: US 8,784,576 B2
(45) Date of Patent: Jul. 22, 2014

(54) CARBURIZING IN HYDROCARBON GAS

(75) Inventors: Marcel Somers, Billund (DK); Thomas Christiansen, Frederikssund (DK)

(73) Assignee: Bodycote Netherlands Holding BV (NL)

( * ) Notice: Subject to any disclaimer, the term of this patent is extended or adjusted under 35 U.S.C. 154(b) by 1114 days.

(21) Appl. No.: 11/922,773

(22) PCT Filed: Jun. 21, 2006

(86) PCT No.: PCT/DK2006/000363

§ 371 (c)(1),
(2), (4) Date: Dec. 21, 2007

(87) PCT Pub. No.: WO2006/136166

PCT Pub. Date: Dec. 28, 2006

(65) Prior Publication Data

US 2009/0178733 A1 Jul. 16, 2009

Related U.S. Application Data

(60) Provisional application No. 60/693,012, filed on Jun. 22, 2005.

(51) Int. Cl.
*C23C 8/20* (2006.01)

(52) U.S. Cl.
USPC ..... 148/235; 148/206; 148/209

(58) Field of Classification Search
USPC ..... 148/235, 206, 209
See application file for complete search history.

(56) References Cited

U.S. PATENT DOCUMENTS

| | | | | |
|---|---|---|---|---|
| 5,424,028 | A * | 6/1995 | Maloney et al. | 420/38 |
| 5,827,375 | A * | 10/1998 | Barbour | 148/225 |
| 7,033,446 | B2 * | 4/2006 | Poor et al. | 148/223 |
| 2002/0064326 | A1 * | 5/2002 | Tanaka | 384/492 |
| 2003/0020214 | A1 | 1/2003 | Poor et al. | |

FOREIGN PATENT DOCUMENTS

| | | | |
|---|---|---|---|
| CH | 641 840 | A5 | 3/1984 |
| EP | 1 193 413 | A1 | 4/2002 |
| WO | 2004/007789 | A2 | 1/2004 |

OTHER PUBLICATIONS

ASM International, Materials Park, Ohio, Properties and Selection: Irons, Steels, and High-Performance Alloys, vol. 1, "Wrought Stainless Steels", pp. 841-846, Mar. 1990.*

El-Rahman, A.M.A, et al., "Effect of $N_2$ to $C_2H_2$ ratio on r.f. plasma surface treatment of austenitic stainless steel", *Surface and Coatings Technology*, vol. 183, pp. 268-274, (2004).

Michal, G.M., et al., "Surface Hardening of Austenitic Steels by Low Temperature Colossal Supersaturation", *Materials Science & Technology 2004, AIST/TMS Proceedings*, vol. II, pp. 347-353, (Sep. 2004).

* cited by examiner

*Primary Examiner* — Jessee Roe
(74) *Attorney, Agent, or Firm* — Cook Alex Ltd.

(57) ABSTRACT

The invention relates to a method of gas carburizing a metallic article, where at least the surface region of the article consists of an alloy with a chromium content of at least 10 wt %. The carburizing is carried out by means of a gas containing carbon, which gas is heated to a temperature below approximately 5500C. The gas is an un-saturated hydrocarbon gas.

19 Claims, 3 Drawing Sheets

CARBURIZING IN HYDROCARBON GAS

This is a U.S. National Stage of PCT International Patent Application No. PCT/DK2006/000363 which was filed Jun. 21, 2006, and claims the benefit of and priority to U.S. Provisional Patent Application No. 60/693,012, filed Jun. 22, 2005.

TECHNICAL FIELD

The present invention relates to a method of gas carburizing an article, where at least the surface region of the article consists of an alloy with a chromium content of at least 10 wt %.

BACKGROUND ART

Thermo-chemical surface treatments of steel by means of carbon or nitrogen carrying gases are well-known processes, called case-hardening or carburizing or nitriding. Nitro-carburizing is a process in which a gas carrying both carbon and nitrogen is used. These processes are traditionally applied to improve the hardness and wear resistance of iron and low alloyed steel articles. The steel article is exposed to a carbon and/or nitrogen carrying gas at an elevated temperature for a period of time, whereby the gas decomposes and carbon and/or nitrogen atoms diffuse through the steel surface into the steel material. The outermost material close to the surface is transformed into a layer with improved hardness, and the thickness of this layer depends on the treatment temperature, the treatment time and the composition of the gas mixture.

Stainless steel has excellent corrosion properties, but is relatively soft and has poor wear resistance, especially against adhesive wear. Therefore, there is a need of improving the surface properties for stainless steel. Gas carburizing, nitriding and nitro-carburizing of stainless steel involve some difficulties, as the passive layer, causing the good corrosion properties, acts as a barrier layer preventing carbon and/or nitrogen atoms from diffusing through the surface. Also the elevated temperatures of the treatments promote the formation of chromium carbides or chromium nitrides. Other alloys with a high chromium content, such as nickel base alloys, suffer from the same difficulties when it comes to case-hardening. The formation of chromium carbides and/or chromium nitrides reduces the free chromium content in the material, whereby the corrosion properties are deteriorated.

Stainless steel has iron as main constituent, whereas nickel base alloys have nickel as main constituent. Apart from chromium, a nickel base alloy may comprise cobalt, aluminium and other alloy elements.

Several methods of case-hardening stainless steel have been proposed by which the above mentioned drawbacks are minimized or reduced.

It is known that a pre-treatment in a halogen-containing atmosphere provides an effective activation of the surface.

EP0588458 discloses a method applying fluorine as an active component in a gas pre-treatment, where the passive layer of the stainless steel surface is transformed into a fluorine-containing surface layer, which is permeable for carbon and nitrogen atoms.

Plasma-assisted thermo-chemical treatment and ion implantation have also been proposed. In this case the passive layer of the stainless steel is removed by sputtering, which is an integrated part of the process.

EP 0248431B1 discloses a method for electroplating an austenitic stainless steel article with iron prior to gas nitriding. The nitrogen atoms can diffuse through the iron layer and into the austenitic stainless steel. After gas nitriding, the iron layer is removed, and a hardened surface is obtained. In the only example of this patent, the process is carried out at 575° C. for 2 hours. At this temperature, chromium nitrides are formed, whereby the corrosion properties are deteriorated.

EP 1095170 discloses a carburizing process in which an article of stainless steel is electroplated with an iron layer prior to carburizing. A passive layer is avoided, and carburizing can be carried out at a relatively low temperature without the formation of carbides.

WO 2004/007789 A1 discloses a process, wherein a layer of Ni, Ru, Co or Pd is applied to the surface of a stainless steel article prior to a case-hardening process, which is carried out below a temperature at which carbides or nitrides are formed. As disclosed in WO 2004/007789, chromium carbides are formed if carburizing is carried out above 550° C. Chromium nitrides are formed if nitriding is carried out above 450° C.

EP 818 555 A1 discloses a method for vacuum carburizing of steel by means of hydrocarbon gas. The process is carried out at temperatures up to 900° C.

Plasma and implantation based processes are a known method of treating an article However, plasma is not considered a method for gas carburizing an article, since it relies on the presence of ionized gas species, which are not present in gaseous treatment. Plasma processes have the disadvantage that accurate control of the carbon/nitrogen content is not possible on the basis of straightforward thermodynamics, but only empirically. In addition, only regions where a plasma can be generated or regions which are in the line-of-sight of the implantation gun can be treated. Moreover, the surface finish may suffer from extensive bombardment of ions (sputtering) during plasma/implantation treatment.

Alternatively, the use of a pre-treatment to activate the stainless steel surface prior to carbon/nitrogen introduction is known. Such pre-treatment involves removal of the natural oxide layer from the surface. The known pre-treatments use halogens, e.g. fluorine for the activation of the stainless steel surface which is associated with several drawbacks. One drawback is the fact that these types of gases are poisonous and highly aggressive and may furthermore be very detrimental for metallic parts in industrial furnaces. The gases can also initiate pitting corrosion in stainless steel impairing the "stainless" property of the steel. Also, exposure to aggressive gas (etching) may strongly deteriorate the surface finish of the stainless steel.

DISCLOSURE OF INVENTION

Figure 1A:
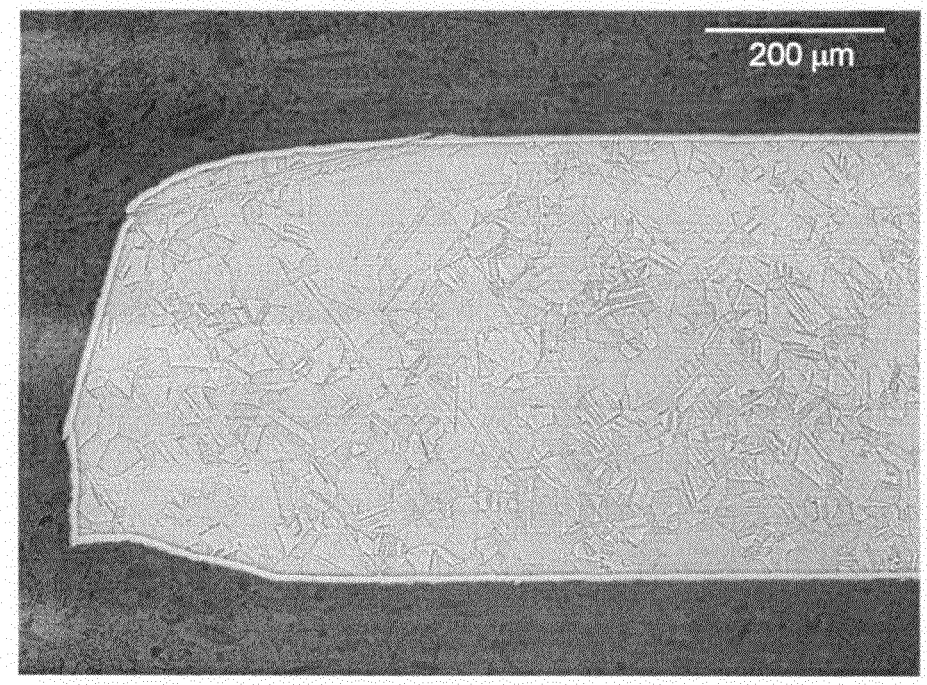
FIG. 1A and FIG. 1B show reflected light optical micrographs of a gas-carburized article of austenitized stainless steel AISI 316L.

The object of the invention is to provide a new and simple method for gas carburizing an article, where at least a surface region of the article consists of an alloy with a chromium content of at least 10 wt %. The object of the invention is obtained by a process according to claim 1, wherein the carburizing is carried out by means of a gas containing carbon, which gas is heated to a temperature below approximately 550° C., wherein the gas is an unsaturated hydrocarbon gas.

Thermochemical gaseous processes, such as gas carburizing and nitriding, have the advantage of accurately controllable process parameters during the treatment. In gaseous processes control of the carbon/nitrogen activity in the gas phase is possible by adjusting the gas composition. Presuming equilibrium between the surface of the article to be treated and the gas gives the possibility of controlling the composition close to the surface and thereby tailoring the composition range of the expanded austenite regions. Gaseous thermochemical processes do not impose restrictions on sample geometry; even very complicated and large geometries, as well as narrow blind holes may be processed.

Hydrocarbons which have one or more double or triple bonds between carbon atoms are called unsaturated hydrocarbons. Unsaturated hydrocarbons with at least one double bond between two carbon atoms are called alkenes. The general molecular formula of alkenes is $C_nH_{2n}$ (assuming only one double bond). Examples of alkenes are ethene ($C_2H_4$) and propene ($C_3H_6$). Unsaturated hydrocarbons with at least one triple bond between two carbon atoms are called alkynes. The general molecular formula of alkynes is $C_nH_{2n-2}$ (assuming only one triple bond). Examples of alkynes are acetylene ($C_2H_2$) and propyne ($C_3H_4$). Alkenes and alkynes are more reactive than alkanes, being saturated hydrocarbons with only single bonds between carbon atoms.

Halogenated saturated or unsaturated hydrocarbon gas is hydrocarbon gas in which at least one hydrogen atom is replaced by a halogen, e.g. fluorine, chlorine, bromine, or iodine. Halogenated saturated or unsaturated hydrocarbon gasses are more reactive than saturated hydrocarbon gasses.

Unsaturated hydrocarbon gas has the advantage that it activates the surface and is a source of carbon for diffusion into the surface. The unsaturated hydrocarbon gas is an all-in-one solution unlike the known processes, e.g. the processes using pre-treatment. Unsaturated hydrocarbon gas, such as acetylene, has furthermore the advantage that it does not cause a detrimental effect on the surface finish of the stainless steel.

Unsaturated hydrocarbon compounds are thermodynamically suitable for carburizing at low temperatures, i.e. the decomposition reaction is thermodynamically favoured. The carburizing potential (carbon activity) can be extremely high, depending on chain length and number of unsaturated bonds, e.g. acetylene gas (mixtures) can impose very high carburizing potentials. The carburizing potential controls the amount of carbon that is possible to incorporate into the stainless steel.

Tests carried out by the inventors have revealed that it is possible to carburize a surface alloy with a chromium content of at least 10 wt % by an unsaturated hydrocarbon gas wherein the gas is heated to a temperature below approximately 550° C. The hydrocarbon gas has a double action. On one hand, the hydrocarbon gas alters the chromium oxide layer which otherwise prevents carburizing, i.e. the surface is activated. On the other hand, the hydrocarbon gas supplies carbon atoms, which diffuse into the surface region and harden it. As the temperature is kept below 550° C., chromium carbides are not formed, whereby the corrosion properties are maintained. The dissolved carbon atoms bring about the development of expanded austenite, which is also called "carbon S-phase". Thus, the method according to the invention provides a simple way of hardening a surface layer with high chromium content, such as stainless steel or a nickel base alloy, without deteriorating the corrosion properties.

In one embodiment of the present invention the gas is halogenated unsaturated hydrocarbon gas. Hereby a more effective surface activation may be obtained.

Furthermore, the gas may further comprise a halogenated hydrocarbon gas according to another embodiment of the present invention. Hereby the same advantages as mentioned above are obtained and the effectiveness of the surface activation may be improved.

In yet another embodiment the hydrocarbon gas may comprise at least one triple bond. If at least part of the hydrocarbon gas comprises at least one triple bond, a particularly efficient case-hardening can be obtained. This is due to the fact that hydrocarbon gases with at least one triple bond, alkynes, are very reactive.

According to an embodiment of the invention the hydrocarbon gas consists at least partly of acetylene ($C_2H_2$). Acetylene is a cheap gas and has shown excellent results.

According to the invention the hydrocarbon gas can be diluted with $H_2$, whereby it is easier to control the carburizing process, i.e. the carbon activity or carburizing capacity of the gas mixture.

Furthermore, dilution of unsaturated hydrocarbon gas with hydrogen improves the effectiveness of the carburizing medium, i.e. a gas mixture consisting of pure unsaturated hydrocarbon gas is less effective in carburizing stainless steel as compared to a hydrogen diluted (e.g. 50/50) mixture. The role of the hydrogen is to be an active part in facilitating the formation of active free-radicals derivates of the unsaturated hydrocarbon compounds, which formation enhances/accelerates the carburizing reaction.

Additionally, the adding of hydrogen serves another purpose, viz. to control the carburizing potential (carbon activity). The carburizing potential is given by the partial pressures of hydrogen and unsaturated hydrocarbon gas. Consequently, it is possible to control the concentration of carbon in the article close to the stainless steel surface by adjusting the gas mixtures of hydrogen/unsaturated hydrocarbon gas.

According to an embodiment of the invention the hydrocarbon gas is mixed with a nitrogen-containing gas, such as $NH_3$, and the temperature is kept below approximately 450° C. In this manner, nitriding can also be carried out without formation of chromium nitrides. Nitriding can improve the hardness and the corrosion resistance further.

By mixing the hydrocarbon gas with a nitrogen-containing gas, also called nitro-carburizing, it is possible to produce a two-layer structure in the surface of the article, consisting of an inner layer of carbon expanded austenite and a surface adjacent layer of nitrogen expanded austenite. The total layer is hereby significantly thicker than what can be obtained with a stand-alone carburizing or nitriding treatment for the same processing time. The amount of carbon dissolved in the carbon expanded austenite is significantly lower than the amount of nitrogen dissolved in the nitrogen expanded austenite.

The nitro-carburizing or successive carburizing and nitriding effectively combine the composition profiles obtained by nitriding and carburizing, in particular regarding the hardness of the surface of the article to be treated. Carburizing leads to an intermediate content of carbon, which effectively bridges the mismatch between the high nitrogen containing nitrogen expanded austenite and the austenite substrate, i.e. the transition from a very hard surface (high interstitial contents/lattice dilation) to the soft substrate occurs smoothly over an extended distance. Technologically, this is very advantageous as the application range of surface hardened stainless steel may be extended further.

Additionally, the nitro-carburizing offers the possibility of tailoring a specific hardness depth profile by controlling the process parameters of the nitro-carburizing treatment. The combination layers of carbon and nitrogen expanded austenite offer significantly thicker layers, having both the high surface hardness from the nitrogen expanded austenite and the load sustainability of the underlying carbon expanded austenite layer. In this way the fatigue properties are also improved due to the characteristic concentration profile inherent in the nitro-carburizing treatment.

At least the surface region of the article is preferably an iron base alloy or a nickel base alloy.

At least the surface region of the article can be made of a ferritic, an austenitic, a martensitic, or a duplex stainless steel.

Alternatively, the surface region of the article can be made of a nickel base alloy.

According to the invention at least the surface region of the article can be made of sintered powder metal.

Naturally, not only the surface region but the complete article can be made of the above mentioned materials.

The carburizing can be carried out at atmospheric pressure. However, the carburizing can also be carried out at sub-atmospheric pressure.

According to an embodiment the carburizing is carried out in a fluidized bed furnace. In this manner, soot formation on the surface can be reduced.

According to an embodiment of the invention one hydrogen atom of at least a part of the hydrocarbon gas is substituted with fluoride (F), chloride (Cl), bromide (Br) or iodide (I).

The unsaturated hydrocarbon gas can be ethene ($C_2H_4$), acetylene ($C_2H_2$), propene ($C_3H_6$), propyne ($C_3H_4$), propadiene ($C_3H_4$) or a mixture of two or more of these.

In another embodiment the unsaturated hydrocarbon gas can be mixed with a saturated hydrocarbon gas, such as methyl chloride ($CH_3Cl$) or methyl fluoride ($CH_3F$).

Examples of halogenated unsaturated hydrocarbon gas could be 1,1-difluoroethylene ($CH_2CF_2$), hexafluoropropylene ($C_3F_6$), vinyl-bromide ($C_2H_3Br$), vinyl-chloride ($C_2H_3Cl$), vinyl-fluoride ($C_2H_3F$).

The above mentioned hydrocarbons are all aliphatic hydrocarbons. However, it is believed that also aromatic hydrocarbons can be applied.

The article is preferably carburized in hydrocarbon gas for at least 1, 2, 5 or 10 hours.

The article is preferably carburized in hydrocarbon gas at a temperature above approximately 350° C.

The article can be carburized in hydrocarbon gas at a temperature below approximately 510° C.

The carburizing can be carried out in a furnace with or without forced circulation.

Figure 1B:
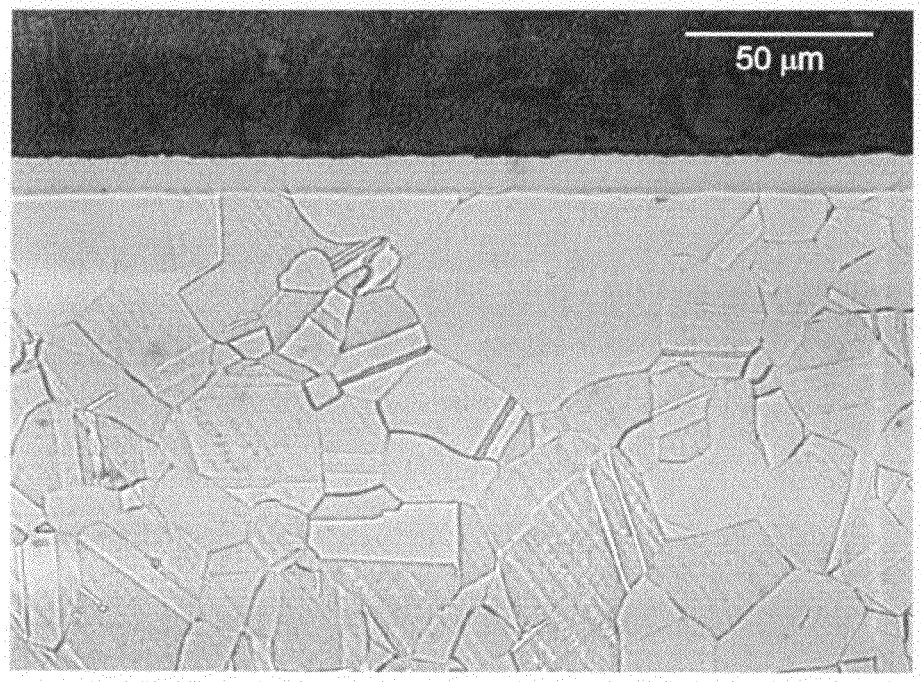

The following examples with accompanying Figures elucidate the invention, in which:

FIG. 1A and FIG. 1B show reflected light optical micrographs of a gas-carburized article of austenitized stainless steel AISI 316L.

Figure 2:
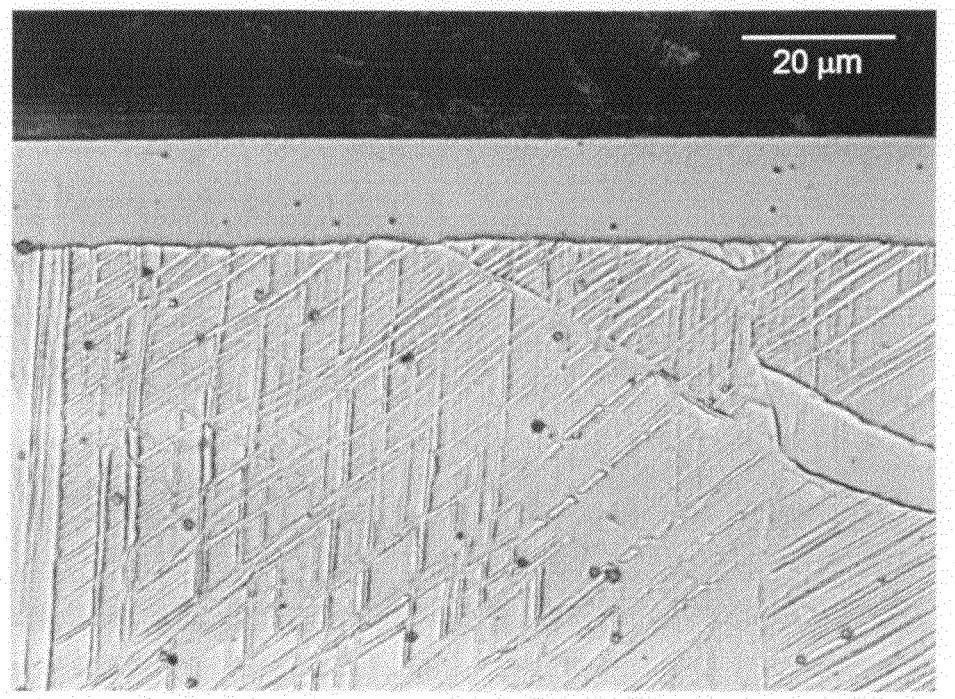
FIG. 2, FIG. 3A and FIG. 4 show reflected light optical micrographs of gas-carburized articles of stainless steel AISI 316.
Figure 3A:
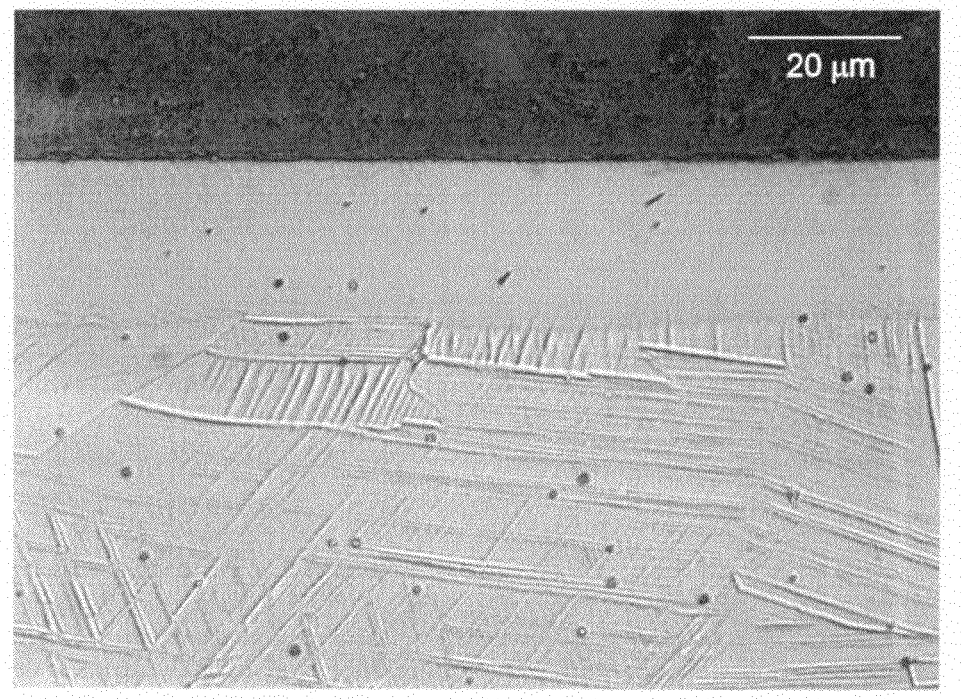
Figure 4:
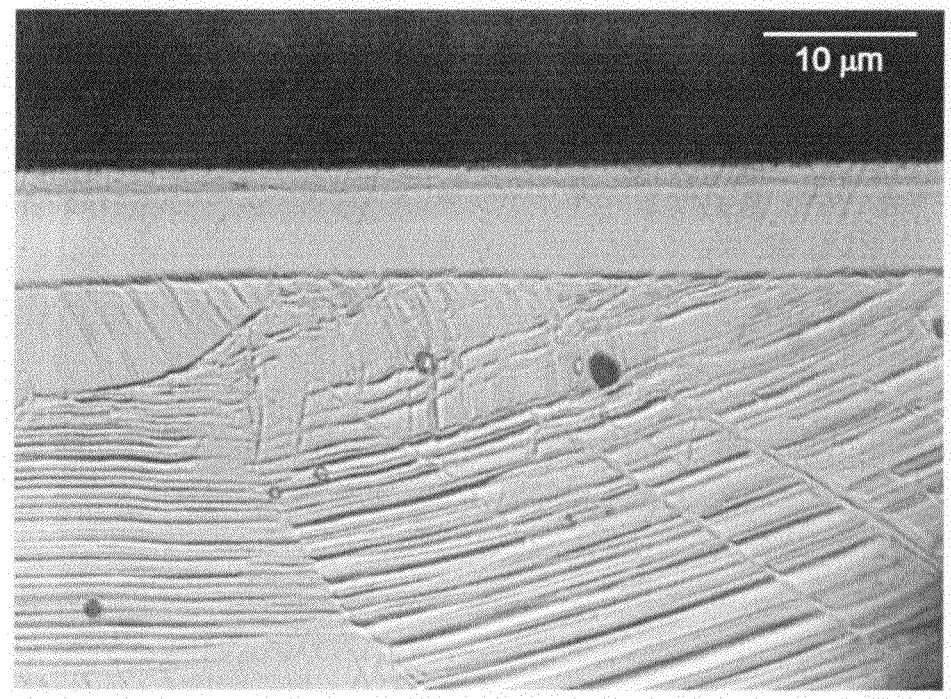

FIG. 2, FIG. 3A and FIG. 4 show reflected light optical micrographs of gas-carburized articles of stainless steel AISI 316.

Figure 3B:
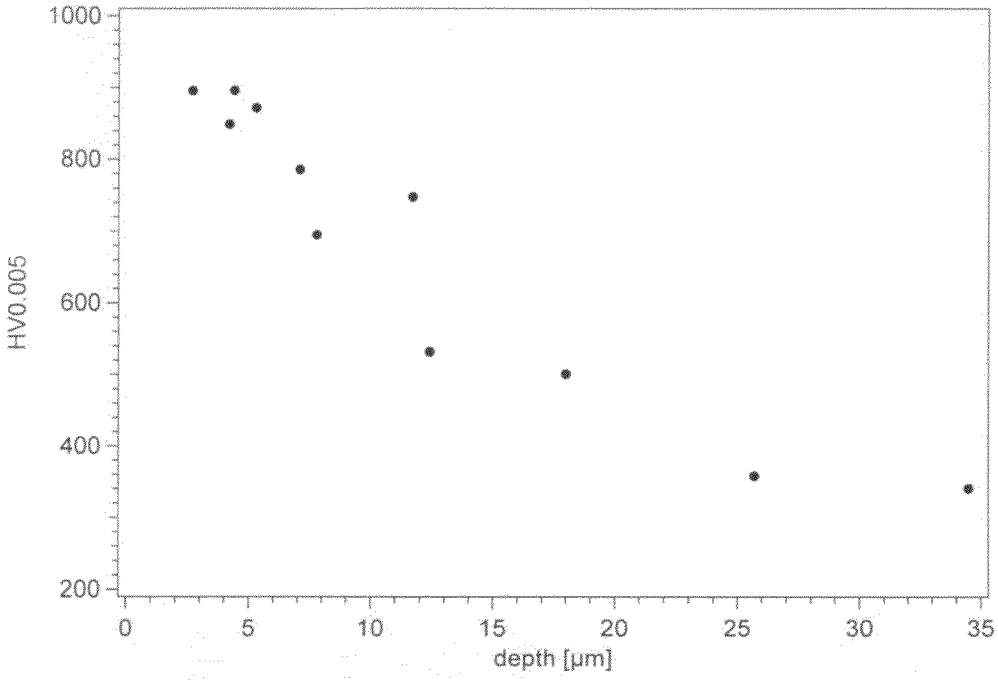
FIG. 3B shows a hardness-depth profile of a gas-carburized article of stainless steel AISI 316L.

FIG. 3B shows a hardness-depth profile of a gas-carburized article of stainless steel AISI 316L.

EXAMPLE 1

An article of austenitized stainless steel AISI 316L was carburized in a gas mixture consisting of 5% $C_2H_2$/86% $H_2$/9% $N_2$ for 14 hours at 430° C. Heating and cooling were carried out in the same gas mixture. The article was analyzed with reflected light optical microscopy (LOM), cf. FIGS. 1A and 1B. The formed layer was carbon expanded austenite (carbon S-phase).

EXAMPLE 2

An article of stainless steel AISI 316 was carburized in a gas mixture consisting of 48% $C_2H_2$/48% $H_2$/4% $N_2$ for 72 hours at 370° C. Heating and cooling were carried out in the same gas mixture. The article was analyzed with reflected light optical microscopy (LOM), cf. FIG. 2. The formed layer was carbon expanded austenite (carbon S-phase).

EXAMPLE 3

An article of stainless steel AISI 316 was carburized in a gas mixture consisting of 48% $C_2H_2$/48% $H_2$/4% $N_2$ for 67 hours at 420° C. Heating and cooling were carried out in the same gas mixture. The article was analyzed with reflected light optical microscopy (LOM), cf. FIG. 3A, and hardness indentation measurements (depth profiling), cf. FIG. 3B. The formed layer was carbon expanded austenite (carbon S-phase).

EXAMPLE 4

AISI 316 was nitro-carburized in a gas mixture consisting of 10% $C_2H_2$/33% $H_2$/49% $NH_3$/8% $N_2$ for 20 hours at 390° C. Heating and cooling were carried out in the same gas mixture. The article was analyzed with optical microscopy (LOM), cf. FIG. 4. The formed layer consisted of nitrogen and carbon expanded austenite (N/C S-phase). The top/surface-layer is nitrogen expanded austenite, whereas the second layer is carbon expanded austenite.

The invention claimed is:

1. A method of gas carburizing an article, where at least a surface region of the article comprises an alloy with a chromium content of at least 10 wt %, wherein the article is carburized with a gas for activation of the surface and as a source of carbon for diffusion into the surface, wherein the gas is heated to a temperature below 550° C., and wherein the gas comprises a halogenated unsaturated hydrocarbon gas.

2. The method according to claim 1, wherein the gas further comprises a halogenated hydrocarbon gas in addition to the halogenated unsaturated hydrocarbon gas.

3. The method according to claim 1, wherein the hydrocarbon gas at least partly contains acetylene ($C_2H_2$).

4. The method according to claim 1, wherein the hydrocarbon gas is diluted with $H_2$.

5. The method according to claim 1, wherein the hydrocarbon gas is mixed with a nitrogen-containing gas, and where the temperature is kept below 450° C.

6. The method according to claim 5, wherein the nitrogen containing gas is $NH_3$.

7. The method according to claim 1, where at least the surface region of the article is an iron or nickel base alloy.

8. The method according to claim 7, wherein at least the surface region of the article is made of a ferritic, an austenitic, a martensitic, or a duplex stainless steel.

9. The method according to claim 7, wherein at least the surface region of the article is made of a nickel based alloy.

10. The method according to claim 1, wherein at least the surface region of the article is made of sintered powder metal.

11. The method of claim 1, wherein the carburizing is carried out at atmospheric pressure.

12. The method according to claim 1, wherein the carburizing is carried out at sub-atmospheric pressure.

13. The method according to claim 1, wherein the carburizing is carried out in a fluidized bed furnace.

14. The method according to claim 1, wherein the hydrogen atom of at least a part of the hydrocarbon gas is substituted with fluoride (F), chloride (CI), bromide (Br) or iodide (I).

15. The method according to claim 1, wherein the hydrocarbon gas comprises acetylene ($C_2H_2$), propane ($C_3H_3$) or a mixture thereof.

16. The method according to claim 1, wherein the surface layer is carburized in hydrocarbon gas at a temperature above 350° C. and below 510° C.

17. The method according to claim 1, wherein the surface layer is carburized in hydrocarbon gas at a temperature below 510° C.

18. A method of gas carburizing an article, where at least a surface region of the article comprises an alloy with a chromium content of at least 10 wt %, wherein the article is carburized with a gas for activation of the surface and as a source of carbon for diffusion into the surface, wherein the gas is heated to a temperature below 550° C., wherein the gas comprises an unsaturated hydrocarbon gas, and wherein at least the surface region of the article is made of sintered powder metal.

19. A method of gas carburizing an article, where at least a surface region of the article comprises an alloy with a chromium content of at least 10 wt %, wherein the article is carburized with a gas for activation of the surface and as a source of carbon for diffusion into the surface, wherein the gas is heated to a temperature below 550° C., wherein the gas comprises an unsaturated hydrocarbon gas, and wherein the carburizing is carried out in fluidized bed furnace.

* * * * *